US005186229A

United States Patent [19]

Hsu

[11] Patent Number: 5,186,229

[45] Date of Patent: Feb. 16, 1993

[54] WINDOW SHADE OPERATOR

[76] Inventor: Henry C. Hsu, 29-42 162th St., Flushing, N.Y. 11358

[21] Appl. No.: 701,441

[22] Filed: May 15, 1991

[51] Int. Cl.[5] ..... E06B 9/30

[52] U.S. Cl. ..... 160/176.1; 160/177; 403/58

[58] Field of Search ..... 160/177, 168.1, 176.1, 160/173, 166.1, 178.1, 172, 900; 403/58, 287; 285/918

[56] References Cited

U.S. PATENT DOCUMENTS

| | | | |
|---|---|---|---|
| 2,436,336 | 2/1948 | Slater | 403/58 |
| 2,499,030 | 2/1950 | Moon | 403/58 X |
| 3,633,646 | 1/1972 | Zilver | 160/176.1 X |
| 3,878,877 | 4/1975 | Bruneau et al. | 160/168.1 |
| 4,141,402 | 2/1979 | Marotto | 160/176.1 |
| 4,257,470 | 3/1981 | Woodle | 160/176.1 X |
| 4,262,728 | 4/1981 | Debs | 160/168.1 |
| 4,507,831 | 4/1985 | McClure | 160/177 X |
| 4,676,292 | 6/1987 | Valle et al. | 160/176.1 |
| 4,875,516 | 10/1989 | Marocco | 160/177 X |
| 5,002,113 | 3/1991 | Georgopoulos | 160/176.1 |
| 5,092,387 | 3/1992 | King et al. | 160/176.1 |

FOREIGN PATENT DOCUMENTS

| | | | |
|---|---|---|---|
| 2164986 | 4/1986 | United Kingdom | 160/178.1 |

*Primary Examiner*—Carl D. Friedman

*Attorney, Agent, or Firm*—Abelman Frayne & Schwab

[57] ABSTRACT

An operator for a window shade has a connection member provided with an internal detent which extends radially inwardly of a hexagonal bore in the connection member, and which is received within a locking recess in an operating rod of corresponding hexagonal cross-section to lock the rod within the connecting member upon insertion of the end of the rod into the connection member.

2 Claims, 3 Drawing Sheets

WINDOW SHADE OPERATOR

FIELD OF THE INVENTION

This invention relates to a joint for tilt rod for use in a window shade, and more particularly to an improved joint which is capable of rotating freely in any direction.

BACKGROUND OF THE INVENTION

A control rod is an indispensable structural component of Venetian blinds. A Venetian blind employs a tilt rod or a tilt cord to tilt the slats of the blind, thus permitting sunlight to enter the room in a controlled manner.

SUMMARY OF THE INVENTION

It is a primary object of the present invention to provide a tilt rod having an improved joint, which is made up of only a few components formed by injection molding and which can be produced and assembled at lower cost than tilt rod joints.

According to the present invention, the tilt rod joint comprises a worm gear case, a U-shaped connection piece, a connection tube, and a rotation rod. The connection piece is pivotally coupled with an axle of a worm gear case. The connection tube is pivotally attached to a connection column of the connection piece. The connection tube is hollow and has two parallel grooves in the circumference thereof. Located between the grooves is a C-shaped piece, which has one free end and a detent formed on the other end thereof. The rotation rod has a bevel located at the top end thereof and a locating slot located under the bevel. When the rotation rod is inserted into the connection tube, the bevel of the rotation rod pushes outwardly the detent of the C-shaped piece so as to permit the detent to be locked into the locating slot of the rotation rod.

DISCUSSION OF THE PRIOR ART

Figure 1:
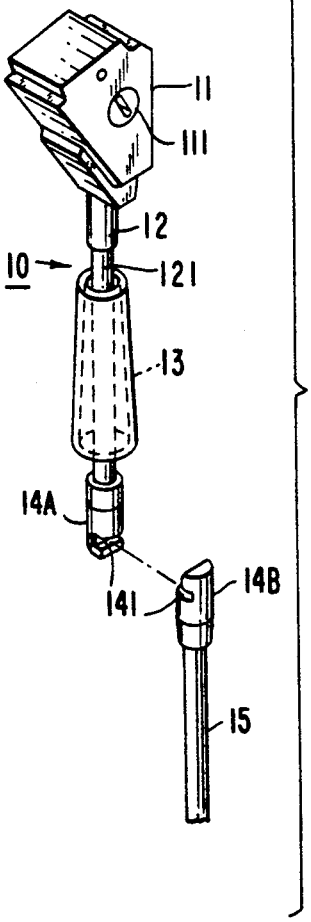
FIG. 1 PRIOR ART
FIG. 1 shows an exploded view of a tilt rod joint of prior art for use in a conventional Venetian blind.

Referring to FIG. 1, a conventional operator for Venetian blind of prior art is shown at 10 consisting of a worm gear case 11 having a worm rod 111 disposed therein. The worm rod 111 engages with a worm gear rod 12, which in turn is coupled with a bendable rod 121. A hollow tube 13 is slidable on the bendable rod 121. In addition, the bendable rod 121 includes a hook block 14A attached at the bottom end thereof. The bottom end hook block 14A comprises a stepped hook portion 141. The rod 15 comprises a hook block 14B affixed at the top end thereof. The engagement of hook blocks 14A and 14B is secured by the hollow tube 13 when it is slid downward. As a result, rotation of the rod 15 drives the worm gear rod 12 and the worm rod 111 so as to regulate the tilting angle of slats. The hook blocks 14A and 14B are made of copper material and are relatively expensive to manufacture. In addition, the bendable rod 121 presents a problem in that it becomes bent during manipulation of the rod 15.

Figure 2:
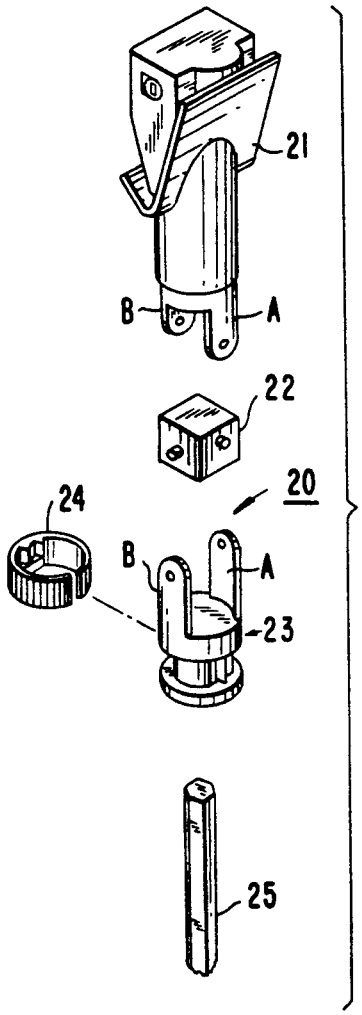
FIG. 2 PRIOR ART
FIG. 2 shows an exploded view of a tilt rod joint of prior art of another type commonly used on conventional Venetian blind.

As shown in FIG. 2, another commonly used tilt rod joint 20 is shown comprising a worm gear case 21, a square connection block 22, a connection socket 23, a C-shaped retaining ring 24, and a rotating rod 25. The tilt rod joint 20 of this construction overcomes the shortcomings of the tilt rod joint 10, as shown in FIG. 1. However, the process of assembling the C-shaped retaining ring 24 onto the connection socket 23 is not an easy task and requires a worker who is skilled in the art. In addition, the process of assembling the connection block 22 and the lugs A and B is not easy if the lugs A and B are too rigid. On the other hand, if the structure of lugs A and B is not sufficiently rigid, loose engagement between the connection block 22 and the lugs A and B will occur.

DETAILED DESCRIPTION OF THE PREFERRED EMBODIMENT

Figure 3:
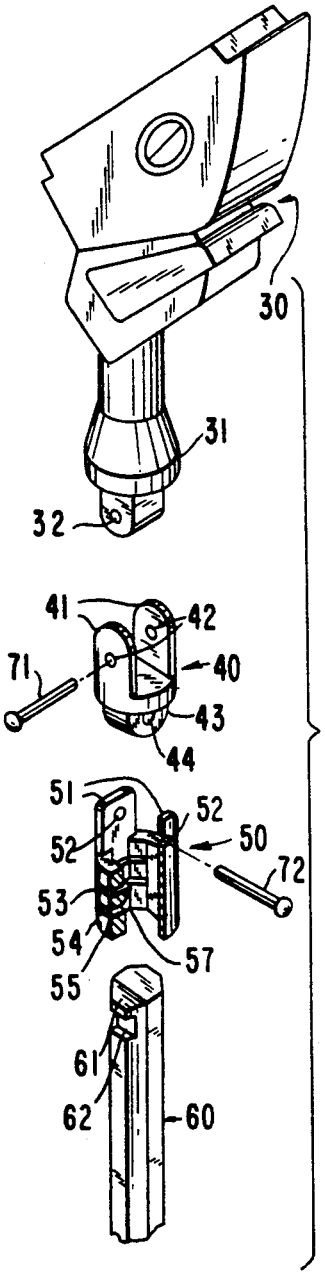
FIG. 3 shows an exploded view of the improved tilt rod joint embodied in the present invention.
Figure 5:
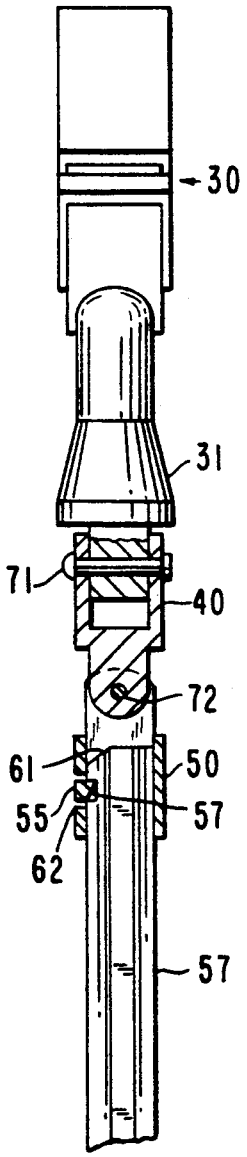
FIG. 5 shows a cut-away view taken longitudinally of the preferred embodiment of the present invention as shown in FIG. 3.
Figure 4:
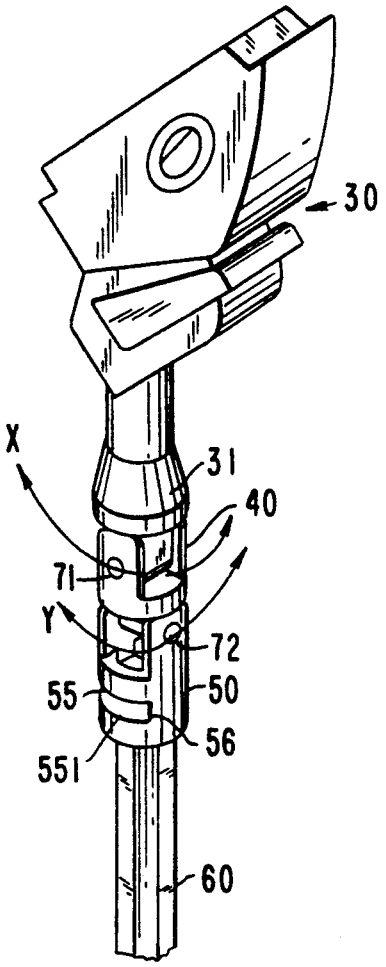
FIG. 4 shows a three-dimensional view of an assembled tilt rod joint embodied in the present invention, with an illustration of direction of motion thereof.
Figure 6:
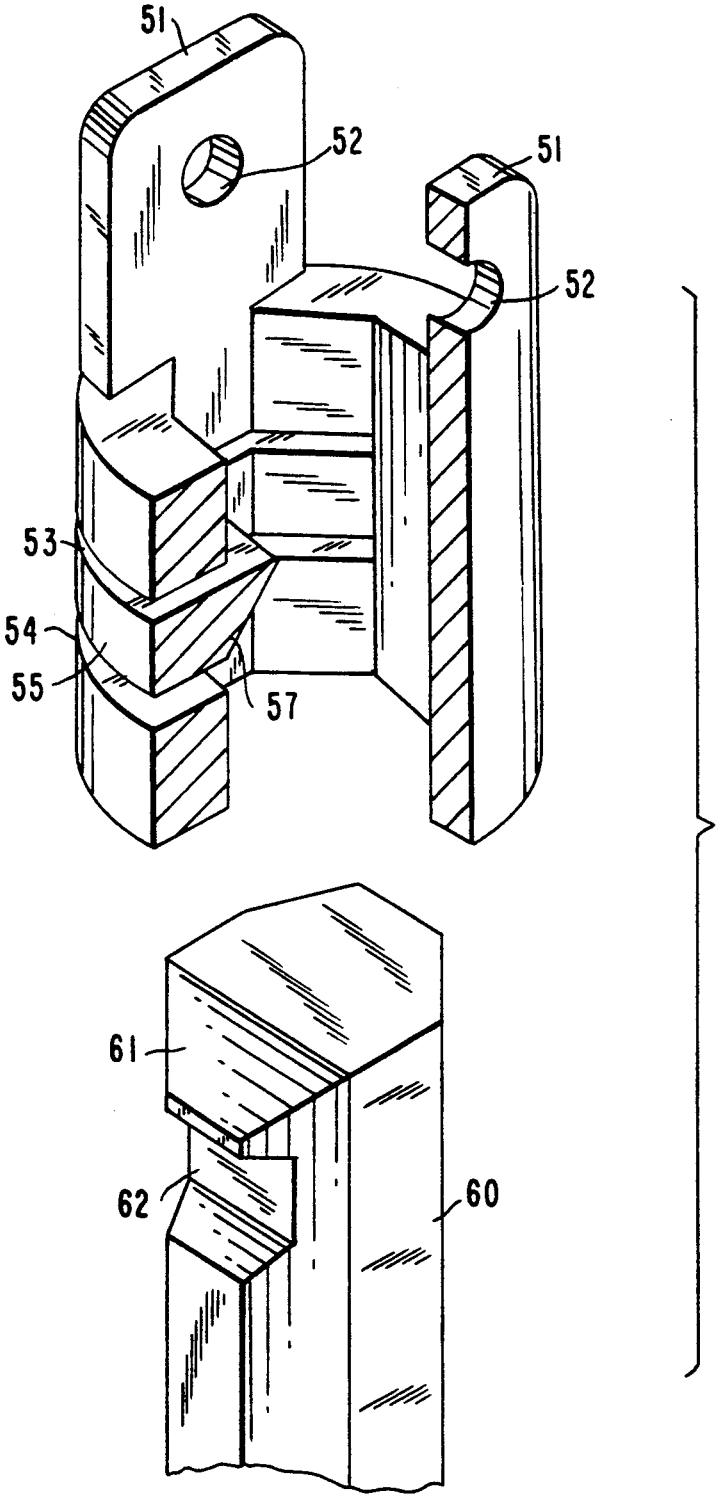
FIG. 6 shows an enlarged detail, partially in section of the connection piece and rotatable rod.

Referring to FIGS. 3–5, the operator of the present invention comprises a worm gear case 30, a connection piece 40, a connection tube 50, a rotatable rod 60, and two hinge pins 71 and 72.

The worm gear case 30 is made of a plastics material comprising an axle 31 having a pin hole 32 disposed at the bottom end thereof.

The U-shaped connection piece 40 is made of a plastics material and includes two side plates 41 and 42, each of which has a pin hole 42 disposed therein. In addition, the connection piece 40 includes a connection column 43 with a pinhole 44 located at the bottom end thereof.

The connection piece 50 is made of a plastics material by means of injection molding, and consists of two side plates 51 located at the top portion thereof, with each side plate 51 having a pin hole 52 disposed therein. The hollow interior of the connection tube 50 is hexagonal. In addition, the connection tube 50 includes two semicircular ring grooves 53 and 54, which are arranged in parallel to each other. A C-shaped piece 55 is arranged between the grooves 53 and 54. The C-shaped piece 55 has a free end 551, provided with a beveled detent 57 which is capable of moving in a radial direction upon flexure of the C-shaped piece 55. There is a gap between the free end 551 of the C-shaped piece 55 and the body wall of the connection tube 50, as shown in FIG. 4.

The rod 60 is a straight rod of a hexagonal shape with a bevel 61 located at the top end thereof. Located under the slant 61 is a locating slot 62.

In the process of assembling the components mentioned above, the axle 31 located at the bottom of the worm gear case 30 is lodged between the two side pates 41 of the connection piece 40. A hinge pin 71 is inserted to traverse the pin holes 32 and 42 so as to pivotally connect the connection piece 40 to the axle 31 in order to rotate an X-axis. The connection column 43 located at the bottom end of the connection piece 40 is pivotally attached to the side plates 51 by means of a hinge pin 72 inserted into pin holes 44 and 52 so as to rotate on a Y-axis.

When the rotation rod 60 is inserted into the connection tube 50 via the bottom of the connection tube 50, the bevel of the rotation rod 60 pushes the detent 57 of the C-shaped piece 55 sideways until the detent 57 is lodged in the locating slot 62 located at the top portion of the rotation rod 60. As a result, the rotation 60 is coupled directly to the connection tube 50 and is held against axial movement relative to the connection tube 50.

What we claim is:

1. In a window shade operator of the type including:

a worm gear case having a drive shaft disposed at a bottom end thereof; and a universal joint connected to the bottom of said drive shaft, and which terminates in a connection member supporting an operating rod; the improvement comprising; said connection member having a recess of hexagonal transverse cross-section for the reception of one end of an operating rod of complementary hexagonal transverse cross-section, and having resilient ring means integral with said connection member providing a detent extending radially into said hexagonal recess, said detent being received within a locking recess provided in said end of said operating rod to lock said rod within said recess upon insertion of said rod into said recess, in which said connection member is of tubular form, and said resilient ring means is provided by axially spaced slots provided in said connection member and positioned on axially opposite sides of said detent.

2. The joint of claim 1, in which said end of said rod is beveled to provide a cam surface operative to displace said detent in a radially outwards direction relative to said connection member, continued movement of said rod relative to said connection member permitting said detent to move into alignment with said locking recess in said rod, and permitting said detent to snap into said recess.

* * * * *